US005839597A

United States Patent [19]

Marttila

[11] Patent Number: 5,839,597

[45] Date of Patent: Nov. 24, 1998

[54] STORAGE BIN WITH RETRACTABLE LID ASSEMBLY

[75] Inventor: John William Marttila, Milford, Ind.

[73] Assignee: CTB, Inc., Milford, Ind.

[21] Appl. No.: 545,340

[22] Filed: Oct. 19, 1995

[51] Int. Cl.[6] ..... B65D 43/26

[52] U.S. Cl. ..... 220/264; 220/331; 49/279; 49/345

[58] Field of Search ..... 220/331, 336, 220/332, 333, 264; 49/279, 345

[56] References Cited

U.S. PATENT DOCUMENTS

| | | | |
|---|---|---|---|
| 1,494,290 | 5/1924 | Ruhmann . | |
| 1,606,621 | 11/1926 | Fischer . | |
| 3,197,060 | 7/1965 | Farniok et al. | 220/331 |
| 4,208,839 | 6/1980 | Candy, Sr. . | |
| 4,327,522 | 5/1982 | Meadows . | |
| 4,561,563 | 12/1985 | Woods | 220/336 |
| 4,598,496 | 7/1986 | Van Daele . | |
| 4,744,183 | 5/1988 | Kruger . | |
| 4,747,244 | 5/1988 | Christianson . | |
| 4,821,902 | 4/1989 | May | 220/331 |
| 5,152,208 | 10/1992 | Ruetschle et al. | 220/331 |
| 5,218,784 | 6/1993 | Pollock . | |
| 5,251,775 | 10/1993 | Kruzick et al. | 220/331 |

*Primary Examiner*—Joseph M. Moy
*Attorney, Agent, or Firm*—Harness, Dickey & Pierce, P.L.C.

[57] ABSTRACT

A retractable lid assembly for covering an opening in a storage bin is disclosed. The retractable lid assembly includes a lid having a first surface facing the storage bin and a second surface opposite to the first surface. A pivot member is pivotably attached to the lid at a first pivot point and pivotably attached adjacent to the opening in the storage bin at a second pivot point. The lid is retracted from the opening in the storage bin by pivoting the lid at the first pivot point and the second pivot point while the first surface of the lid remains substantially facing the storage bin during retraction of the lid.

25 Claims, 10 Drawing Sheets

STORAGE BIN WITH RETRACTABLE LID ASSEMBLY

BACKGROUND OF THE INVENTION

1. Field of the Invention

This invention relates generally to storage bins and, more particularly, to a retractable lid assembly for covering an opening located at the top of a storage bin.

2. Discussion of the Related Art

In various industries such as those involving agriculture and manufacturing, it is often necessary to store relatively large amounts of granular material in storage bins. In agriculture, for example, it is often necessary to store substantial quantities of feed for animal husbandry operations. When used in such instances, the granular material is generally loaded into a storage bin from an opening located at the top of a conical shaped portion of the storage bin. The granular material is then later removed from the storage bin immediately prior to use through an opening located at the bottom of a funnel shaped portion of the storage bin.

In order to prevent the granular material stored in the storage bin from degrading, it is generally necessary to cover the opening located at the top of the storage bin during inclement weather. For example, it is generally desirable to keep moisture such as rain or snow from accumulating in the storage bin. In addition, it is sometimes desirable to vent the storage bin through the opening located at the top of the storage bin. This ventilation allows heat and humid air to escape from the storage bin thereby keeping the granular material in a substantially dry state.

Lids which have been used in the past to cover the opening located at the top of the storage bin are generally hinged or pivoted at one pivot point so that the lids can be readily flipped open or closed. Since the storage bin is generally very large, the hinged lid often includes an opening and closing mechanism attached to the lid which can be operated by a user. This mechanism enables the user to conveniently open and close the lid atop the storage bin generally from ground level without having to climb atop the storage bin. However, use of such prior art hinged lid assemblies has several disadvantages.

For example, one problem encountered with prior art hinged lid assemblies is that the lids generally only pivot between 90° and 180° relative to the storage bin opening. Since the top portion of the storage bin is generally conical shaped, this causes the prior art lids to protrude or extend out from the opening at the top of the storage bin. The protruding lid is thus often times struck by loading equipment such as augers or downspouts when attempting to fill the storage bin at the opening, thereby causing damage to the lid, the opening and closing mechanism, as well as the loading equipment.

Still further, because the lids are generally designed to be water tight, most prior art lids have a lip positioned about the circumference of the lid which extends over the opening of the storage bin when the lid is closed. However, by pivoting or flipping open the hinged lid about a single pivot point, this causes the upturned lip of the lid to act as a storage or catching basin for moisture should it happen to rain while the lid is open or for debris as the storage bin is being filled. Thus, upon flipping the hinged lid closed, the moisture and debris accumulated or caught in the lid is subsequently deposited into the storage bin. The moisture and debris also causes the inside of the lid to corrode or rust.

Moreover, prior art lid assemblies are generally difficult to attach to the storage bins and have many individual parts.

For instance, many times a user is required to enter into the inside of the storage bin to attach the lid assembly, as well as to maintain and repair the lid assembly. This results in a substantial increase in labor costs for installation and maintenance of the prior art lid assemblies.

What is needed then is a retractable lid assembly for a storage bin which does not suffer from the above-mentioned disadvantages. This will, in turn, reduce or eliminate the possibility of striking the lid assembly with loading equipment; prevent the lid assembly and loading equipment from becoming damaged; eliminate the need for repairing damaged lid assemblies, thereby reducing cost; eliminate the accumulation of moisture or debris atop the lid when the lid is opened, thereby reducing the amount of moisture or debris from entering the storage bin; reduce corrosion on the inside of the lid; and reduce the installation and maintenance costs by eliminating the need to enter inside the storage bin. It is, therefore, an object of the present to provide such a retractable lid assembly for a storage bin.

SUMMARY OF THE INVENTION

In accordance with the teachings of the present invention, a retractable lid assembly for covering an opening in a storage bin and the method therefore is disclosed. This is basically achieved by pivoting the lid away from the opening in the storage bin as a first surface of the lid remains facing the storage bin during retraction of the lid.

In one preferred embodiment, a lid having a first surface facing the storage bin and a second surface opposite said first surface is used to cover the opening in the storage bin. A pivot member is pivotably attached to the lid at a first pivot point and pivotably attached adjacent to the opening in the storage bin at a second pivot point. The lid is retracted from the opening in the storage bin by pivoting the lid at the first pivot point and the second pivot point while the first surface of the lid remains facing the storage bin during retraction of the lid.

Use of the present invention provides a retractable lid assembly for covering an opening in the storage bin and a method therefore. As a result, the aforementioned disadvantages associated with the prior art lid assemblies have been substantially eliminated.

BRIEF DESCRIPTION OF THE DRAWINGS

Still other advantages of the present invention will become apparent to those skilled in the art after reading the following specification and by reference to the drawings in which.

DETAILED DESCRIPTION OF THE PREFERRED EMBODIMENT(S)

The following description of the preferred embodiments concerning a retractable lid assembly for a storage bin are merely exemplary in nature and are in no way intended to limit the invention or its application or uses. Moreover, while the present invention is described in detail below with reference to storing grain for agricultural purposes, it would be appreciated by those skilled in the art that the present invention, as defined by the appended claims, is clearly not limited to only the agricultural field and may include other fields such as manufacturing, construction, chemical, petroleum or other industrial fields where storage of various materials is required.

Figure 1:
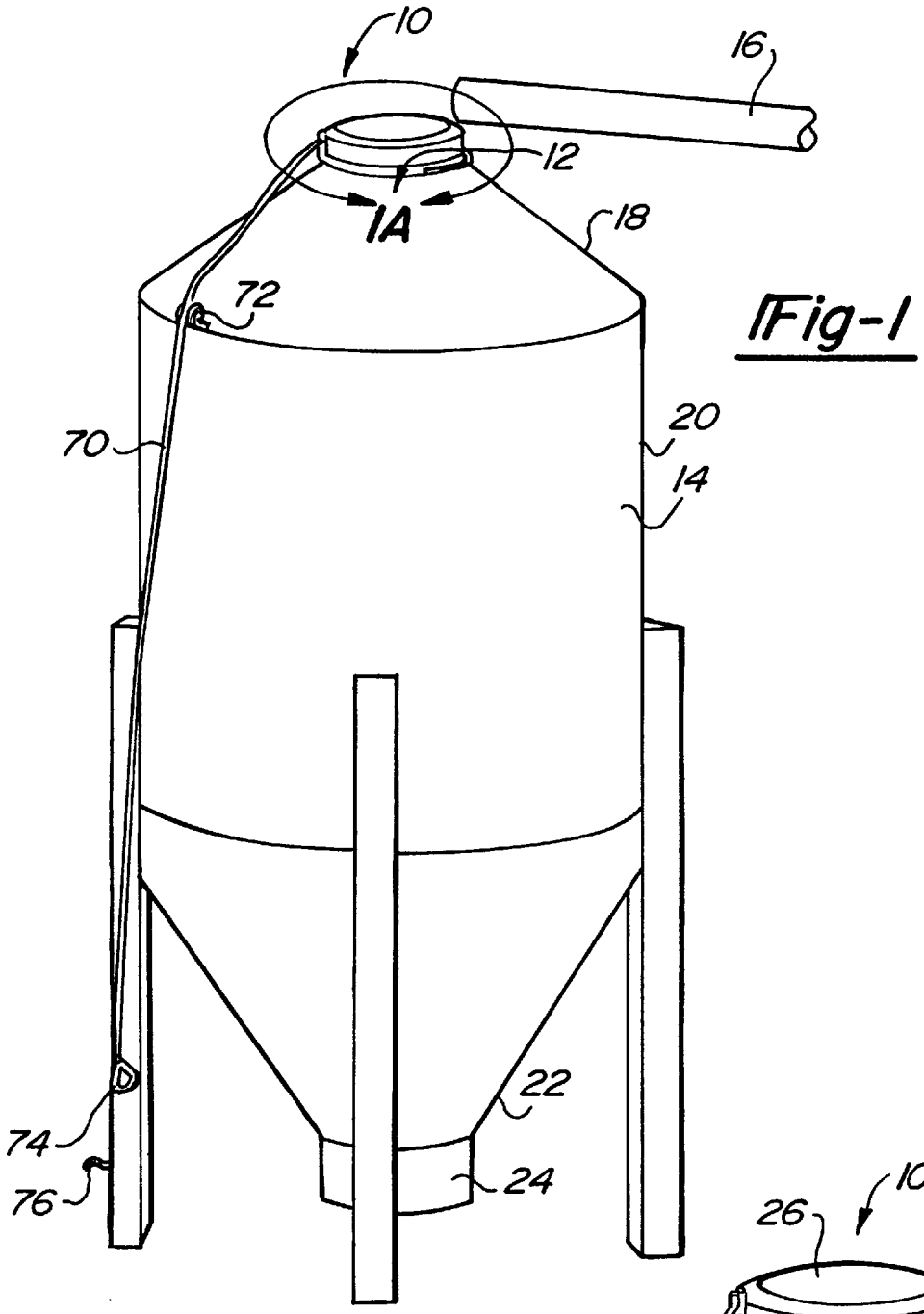
FIG. 1 is a perspective view of a storage bin utilizing a retractable lid assembly according to the teachings of one preferred embodiment of the present invention.
Figure 1A:
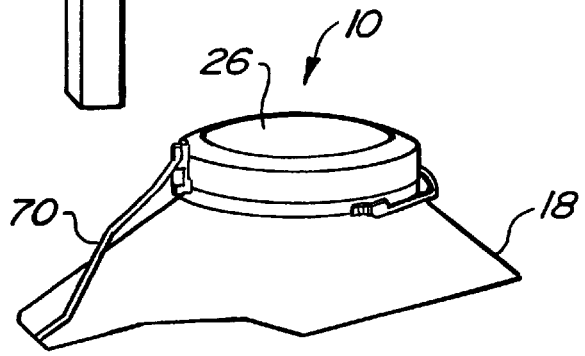
FIG. 1A is an enlarged perspective view of the retractable lid assembly of FIG. 1 taken about line 1A in FIG. 1.
Figure 2:
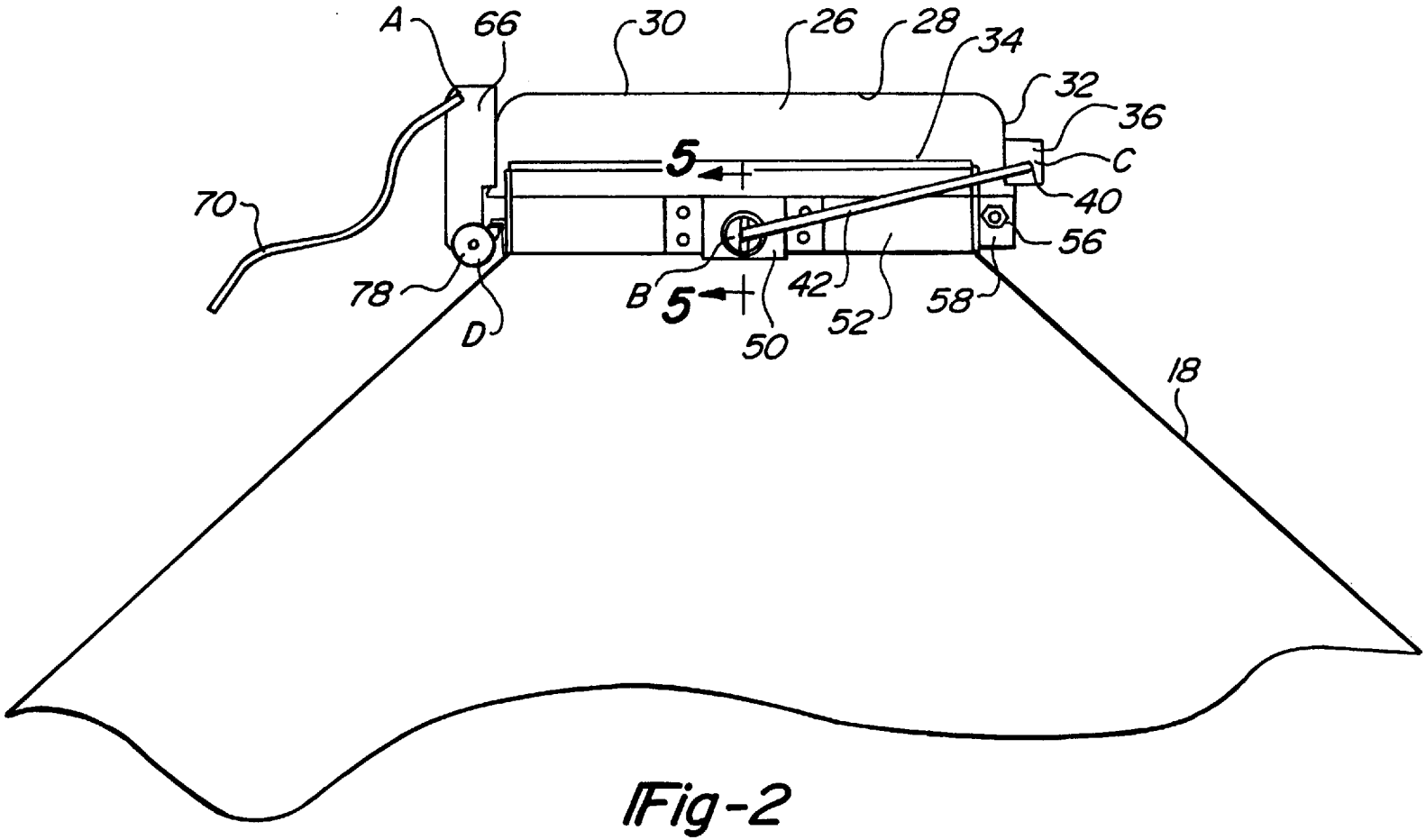
FIG. 2 is a side view of the retractable lid assembly of FIG. 1 shown in a closed position.

Referring to FIGS. 1 and 1A, a retractable lid assembly 10 for covering an opening 12 in a storage bin 14 is shown. The storage bin 14 may be used to store grains, feed or food products or other bulk materials for agricultural or industrial use. The storage bin 14 includes the opening 12 which receives an inflow of granular material from a dispensing device 16 such as an auger or a downspout when the lid assembly 10 is in a retracted or opened position. A conical shaped portion 18 extends from the opening 12 and a generally circular sidewall portion 20 is used for containing the granular material received by the storage bin 14. The storage bin 14 further includes a lower funnel shaped portion 22 which is used for guiding the granular material downward into a lower output portion 24. As those skilled in the art will appreciate, the lower output portion 24 permits removal of the granular material from the storage bin 14 by any suited means such as that which is disclosed in U.S. Pat. No. 4,640,230, which is hereby incorporated by reference.

As will be appreciated by those skilled in the art, the storage bin 14 may be a feed storage bin of the type which is available from CTB or Brock, Milford, Ind. However, it will be understood that the present invention may be used with other types of storage bins or containers, as well as used for distributing other types of materials. In this regard, the storage bin 14 may be used for storing other types of agricultural materials, consumable materials, industrial materials, chemical materials, as well as virtually any other type of material. In addition, while the storage bin 14 is shown as being generally cylindrical in shape with the conically shaped top portion 18, the storage bin 14 may be virtually any other shape which is suitable for storing the material. Accordingly, the storage bin 14 may be rectangular, hexagonal, octagonal or any other suitable shape.

Referring now to FIGS. 2–5, one preferred embodiment of the retractable lid assembly 10 will be more fully described. The retractable lid assembly 10 includes a lid 26 having a substantially circular shape with a first surface 28 facing the storage bin 14 and the opening 12 and a second surface 30 opposite the first surface 28. Those skilled in the art will also appreciate that the lid 26 may have various other shapes such as a square, rectangle, triangle, etc. which can be configured to fit various shaped openings 12. A lip 32 extends substantially perpendicular about the circumference of the lid 26 and covers a rim 34 of the opening 12 when the lid 26 is positioned atop the opening 12 to provide a substantially weather-tight seal. A bail arm bracket 36 is secured to the lip portion 32 of the lid 26 preferably by welds 38, shown clearly in FIG. 4. The bail arm bracket 36 includes two (2) apertures 40 which pivotably secure or attach a bail arm 42. The bail arm 42 is preferably comprised of a solid cylindrical rod which is bent at about 45° at points 44 and 46 and at about 90° at points 48.

The bail arm 42 is pivotably secured or attached to bail mounts 50 which are secured to a collar member 52, preferably by welds 54. The collar member 52 is adjustably mounted about the rim 34 of the opening 12 with a nut and bolt assembly 56. The nut and bolt assembly 56 passes through a tab portion 58 of the collar member 52 such that upon tightening the nut and bolt assembly 56, the collar member 52 is tightened about the rim 34. The collar member 52 thus enables the retractable lid assembly 10 to be easily mounted to existing storage bins 14. However, one skilled in the art would also appreciate that the bail mounts 50 can be directly mounted to the rim 34 of the storage bin 14 during fabrication of the storage bin 14.

Figure 5:
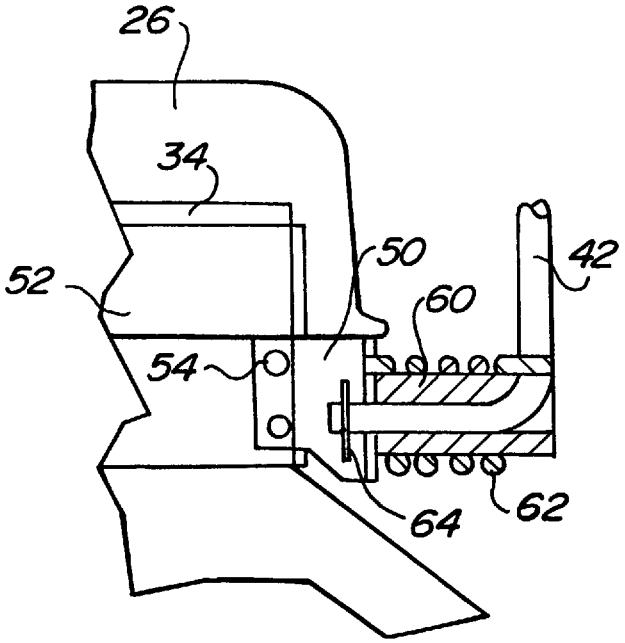
FIG. 5 is a side cross-sectional view of the retractable lid assembly of FIG. 1 taken along line 5—5 of FIG. 2.

Referring to FIG. 5, the bail arm 42 passes through spring mandrels 60 which support torsion springs 62 before extending through the bail mounts 50. The bail arm 42 is pivotably secure within the bail mounts 50 with cotter pins 64 or other suitable means. The torsion springs 62 are attached to the bail mounts 50 and the bail arm 42 so that as the bail arm 42 is rotated counterclockwise, the torsion springs 62 are wound-up to provide a returning or closing torque to the bail arm 42, as will be discussed in detail shortly. In addition, by pre-tensioning the torsion springs 62, the spring torque can be used in place of a latch to hold the lid 26 in a closed position atop the opening 12.

A retraction arm 66 is also secured to the lid 26 by a weld or other suitable means. The retraction arm 66 includes an aperture 68 used to secure a rope 70, or other linkage members such as a chain, cable or solid member. The rope 70, shown clearly in FIG. 1, extends down along the conical portion 18 of the storage bin 14, over an optional pulley 72 and along the side wall 20. At the end of the rope 70 is a loop 74 which engages a hook 76 when the lid 26 is retracted from the opening 12. Those skilled in the art would also recognize that many other suitable means could also be used to secure the rope 70 when the lid 26 is retracted to a fully retracted position, whereby the rope 70 can be easily and safely secured and released. The rope 70 enables a user (not shown) at ground lever to retract or open the lid assembly 10 without having to climb atop the storage bin 14.

A slide wheel 78 is mounted to the retraction arm 66 which is used to roll along the conical portion 18 as the lid 26 is retracted from the opening 12. The slide wheel 78 could also be replaced with simply a rigid slide block or other member to keep the lid 26 extended above the conical portion 18 as the lid 26 is retracted from the opening 12 and slid down or along the conical portion 18.

Figure 2A:
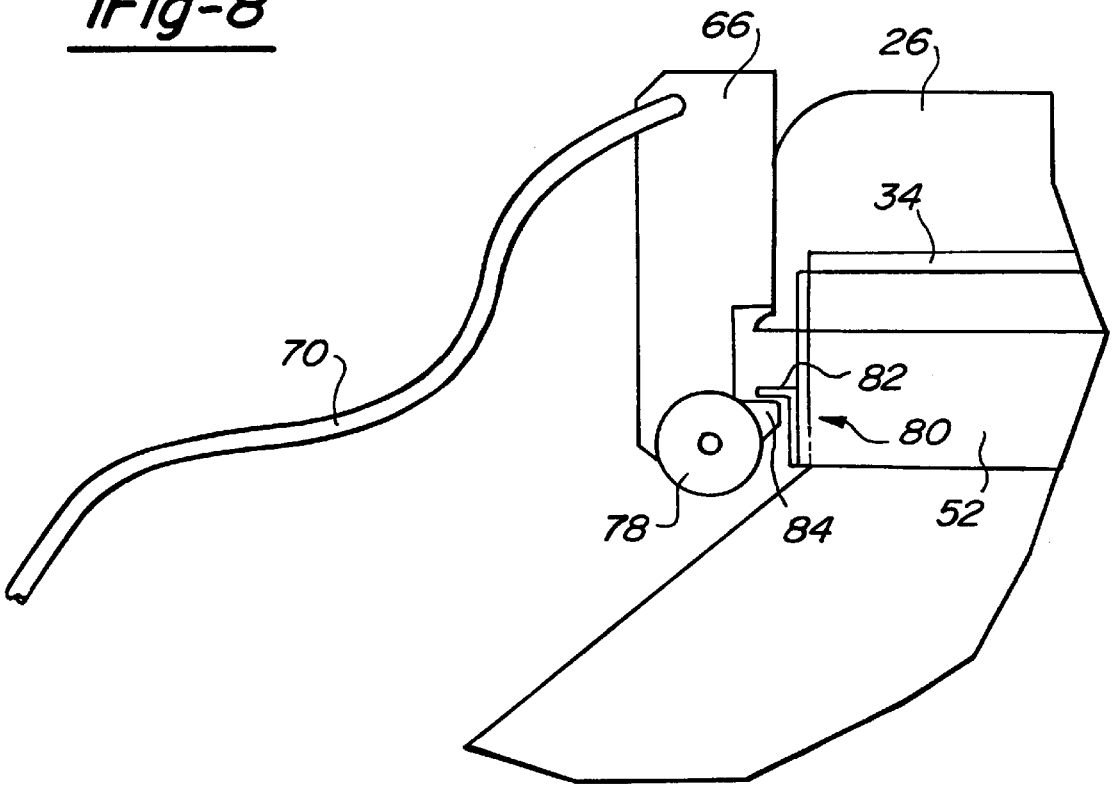
FIG. 2A is an enlarged side view of a latch assembly utilized by the retractable lid assembly of FIG. 1.

Positioned adjacent to the retraction arm 66 and the slide wheel 78 is a latch assembly 80, shown clearly in FIG. 2A.

The latch assembly 80 includes a catch 82 which is secured to the collar member 52 and extends substantially perpendicular from the collar member 52. The catch 82 abuts a step portion 84 of the retraction arm 66. When the catch 82 engages the step portion 84, the latch assembly 80 prevents the lid 26 from being flipped over in a clockwise direction due to high winds or other inclement weather conditions.

In operation, a user grasps the rope 70 at loop 74 with one-hand and pulls the rope 70 downward about twenty-five (25) inches until the loop 74 is able to engage the hook 76. This movement causes the rope 70 at point A to create a turning moment just above point B where the lid 26 rests atop the bail mounts 50. This turning moment causes the lid 26 just below point C where the lid rests atop the tab 58 to begin rising, shown clearly in phantom lines in FIG. 3. The wheel 78 at point D allows the lid 26 to freely travel down and along the conical portion 18 of the storage bin 14, while also allowing the catch 82 to disengage the step portion 84 of the latch assembly 80.

The bail arm 42 freely pivots at the first pivot point, designated point C, within the bail arm bracket 38. The bail arm 42 also pivots at a second pivot point, designated point B, so as to wind up the torsion springs 62 which will provide a returning or closing torque on the bail arm 42. The torsion springs 62 require about 10 to 15 pounds of pull force to pivot the bail arm 42 about point B.

The bail arm 42 having the first and second pivot points (i.e. C and B) enables the lid 26 to be retracted from the opening 12 in the storage bin 14, while the first surface 28 of the lid 26 remains substantially facing the storage bin 14 and the opening 12 throughout the retraction motion. This double pivot action allows the lid 26 to be retracted or removed from the opening 12 without flipping the lid 26 over such that the first surface 28 of the lid 26 would face away from the storage bin 14. Such an undesirable condition would enable the upturned lip 32 of the lid 26 to catch and accumulate moisture or debris. Still further, the double pivot action enables the lid 26 to remain substantially flush against the storage bin 14 during retraction. Thus, in the fully retracted position, shown in FIG. 3, the lid 26 is flush against the conical portion 18 of the storage bin 14 which substantially reduces the chance that the lid 26 will be struck by the dispensing device 16.

Figure 3:
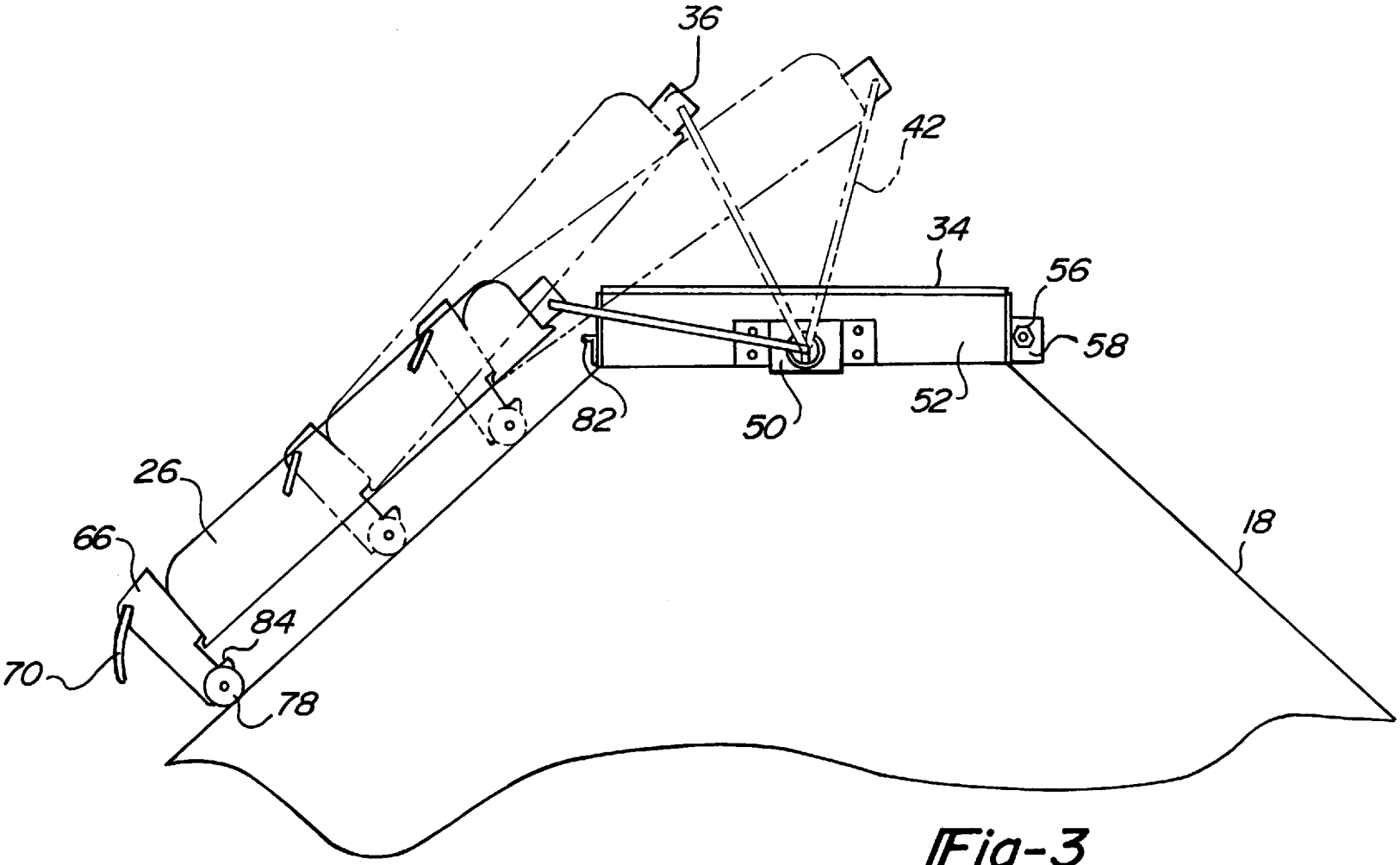
FIG. 3 is a side view of the retractable lid assembly of FIG. 1 shown in a retracted or open position.
Figure 4:
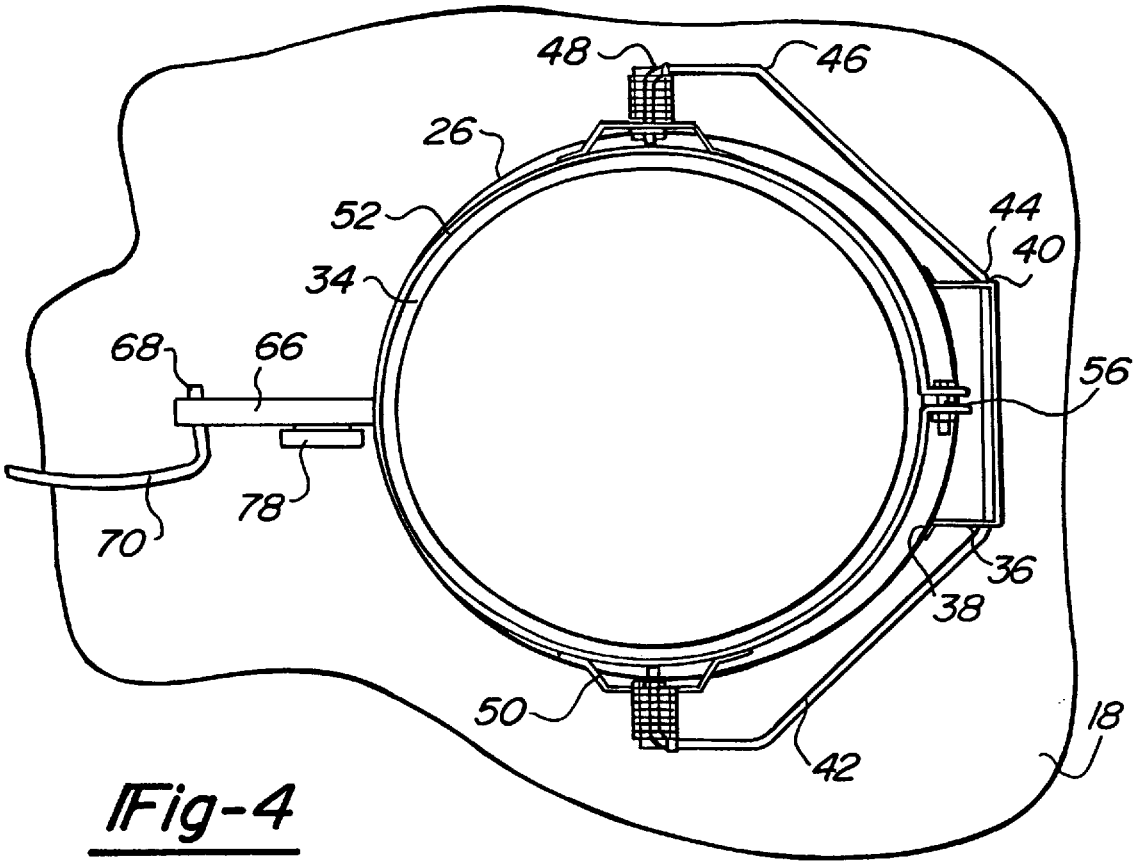
FIG. 4 is a top view of the retractable lid assembly of FIG. 1.

Once the lid 26 has been fully retracted to its retracted position, shown in FIG. 3, the loop 74 of the rope 70 is engaged with the hook 76. By engaging the loop 74 about the hook 76, the lid 26 is held open in its fully retracted position. In order to close the lid 26 and return it atop the opening 12 of the storage bin 14, the loop 74 is simply removed from the hook 76. As the rope 70 is allowed to move upward, the lid 26 automatically slides upward along the conical portion 18 of the storage bin 14 on the wheel 78. Upon returning the lid 26 substantially atop the opening 12, the step portion 84 of the latch assembly 80 automatically engages the catch 82 before the lid 26 returns to its fully closed position. It should be noted that the lid assembly 10 can also be used without the latch assembly 80 by relying on the rope 70 to hold down the lid 26 atop the opening 12.

Figure 6:
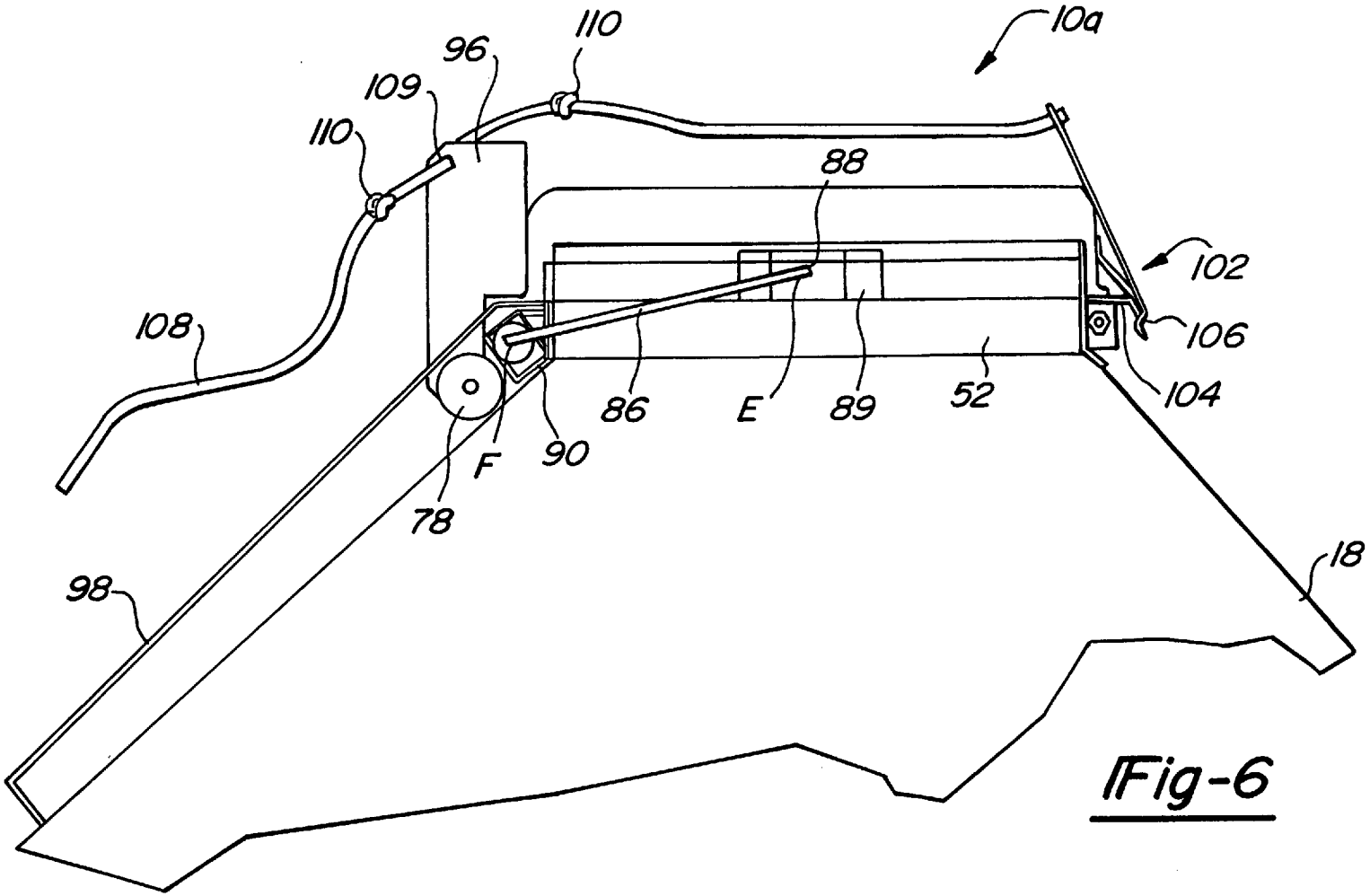
FIG. 6 is a side view of the retractable lid assembly according to the teachings of a second preferred embodiment of the present invention shown in a closed position.
Figure 7:
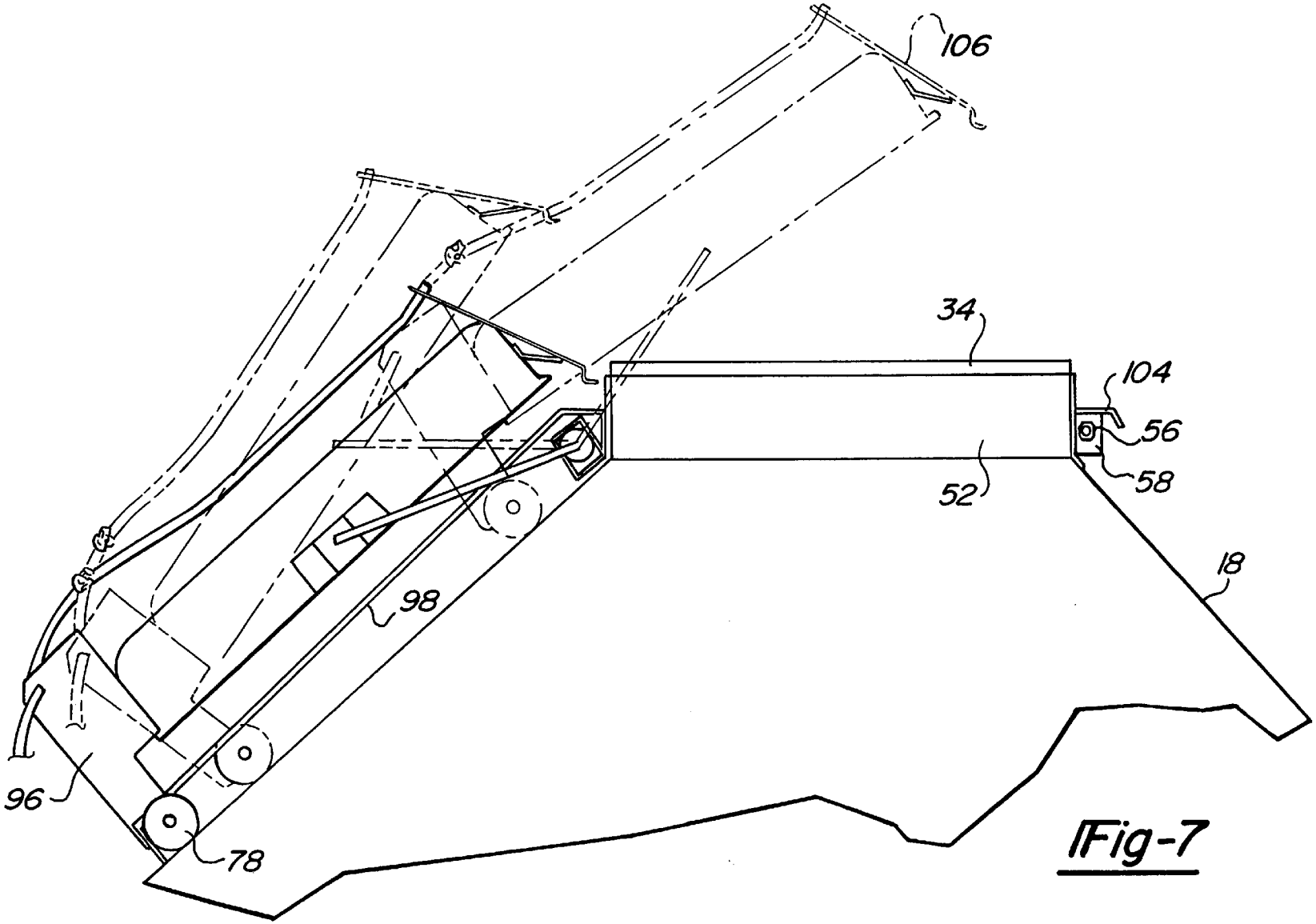
FIG. 7 is a side view of the retractable lid assembly of FIG. 6 shown in a retracted or open position.
Figure 8:
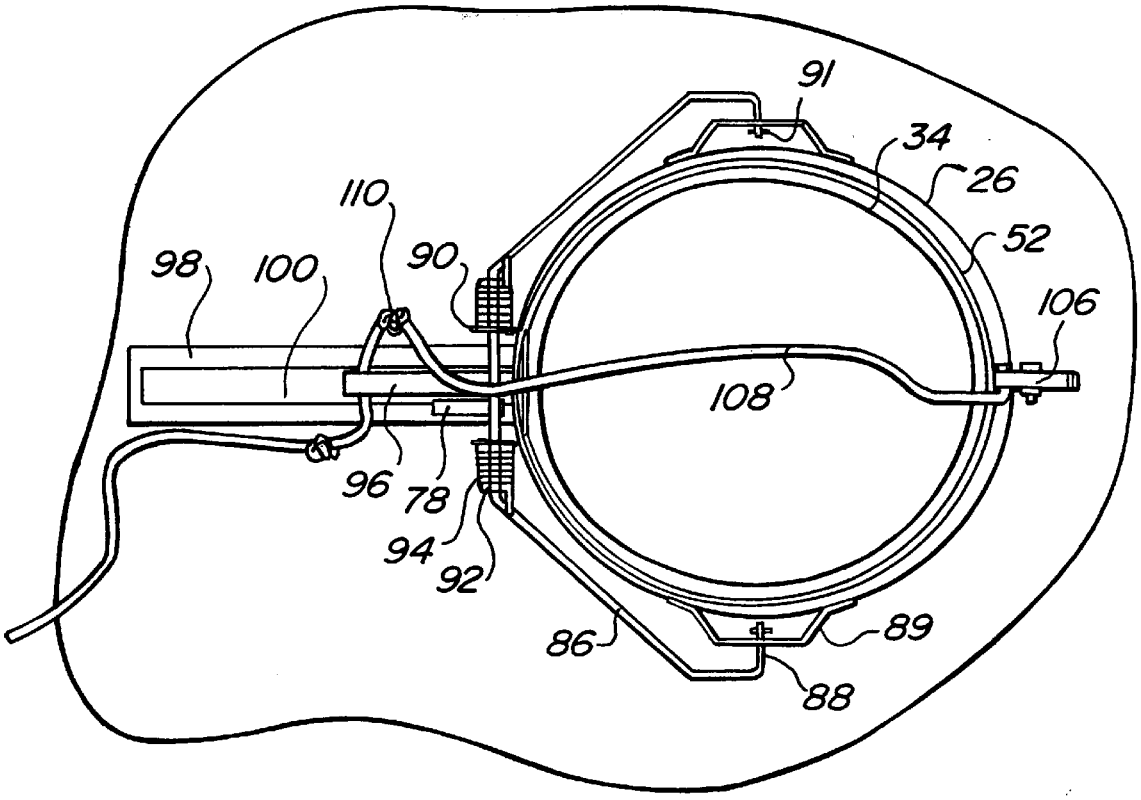
FIG. 8 is a top view of the retractable lid assembly of FIG. 6.

Referring now to FIGS. 6–8, a second preferred embodiment of a retractable lid assembly 10*a* is shown. In this regard, like reference numerals will be used to reference similar elements which have been described in connection with the first preferred embodiment of the present invention. The retractable lid assembly 10*a* includes the lid 26 which is pivotably attached to a bail arm 86 through apertures 88 in bail mounts 89, via cotter pins 91 or other like devices. The bail arm 86 is also pivotably attached to a bail arm bracket 90 which is secured to the collar member 52. The collar member 52 is adjustably mounted about the rim 34, via the nut and bolt assembly 56. Attached to the bail arm 86 and the bail arm bracket 90 are spring mandrels 92 and torsion springs 94. The torsion springs 94 are wound-up when the bail arm 86 is rotated counterclockwise to provide a returning or closing torque to the bail arm 86.

A retraction arm 96 having a shape somewhat similar to the retraction arm 66 is secured to the lid 26 and includes the wheel 78. The wheel 78 is positioned under a slide rail 98, via a groove 100. The slide rail 98 maintains the wheel 78 from being flipped up away from the conical portion 18 of the storage bin 14 during high wind conditions which would thus turn the lid 26 in a clockwise direction. It should also be noted that the retractable lid assembly 10*a* does not require the slide rail 98 to operate properly. Moreover, the slide rail 98 may also be used with the retractable lid assembly 10, shown in FIGS. 2–5, in place of the latch assembly 80 or in place of relying on the rope 70 to hold down the lid 26 atop the opening 12.

Secured to the front of the lid 26 is a latch assembly 102. The latch assembly 102 includes a catch 104 secured to the collar member 52 and a latch bar 106 secured to the lid 26. The catch 104 and the latch bar 106 are made of resilient members such that the latch bar 106 and the catch 104 are able to flex as the latch bar 106 engages the catch 104, upon closing the lid 26. Those skilled in the art can also appreciate that the latch assembly 102 can be eliminated by simply pretensioning torque springs 94.

Attached to the retraction arm 96 and the latch bar 106 is a rope 108. The rope 108 slidably passes through an aperture 109 in the retraction arm 96 and is secured to the latch bar 106. The rope 108 includes knots 110 such that the latch bar 106 can be flexed to disengage the latch bar 106 from the catch 104 upon pulling the rope 108 prior to moving the retraction arm 96.

The operation of the retractable lid assembly 10*a*, as shown in FIG. 7, is substantially similar to the retractable lid assembly 10, shown in FIGS. 2–5. Specifically, the user pulls the rope 108 with one-hand at ground level. The rope 108 first releases the latch bar 106 before the knot 110 engages the retraction arm 96. Upon engagement, the lid 26 is pivoted at a first pivot point, designated point E, and a second pivot point, designated point F, via the bail arm 86. This double pivot action enables the lid 26 to be retracted while the first surface 28 of the lid 26 remains substantially facing the storage bin 14. In addition, the double pivot action enables the lid 26 to remain flush against the conical portion 18 of the storage bin 14 in its fully retracted position without flipping the lid 26 over such that the first surface 28 would face away from the storage bin 14.

To return the lid 26 atop the opening 12, the rope 108 is simply released which allows the torque built up in the torque springs 94 to automatically return the lid 26 atop the opening 12. Upon returning to the opening 12, the latch bar 106 resiliently engages the catch 104 to automatically latch the lid 26 atop the opening 12.

Figure 9:
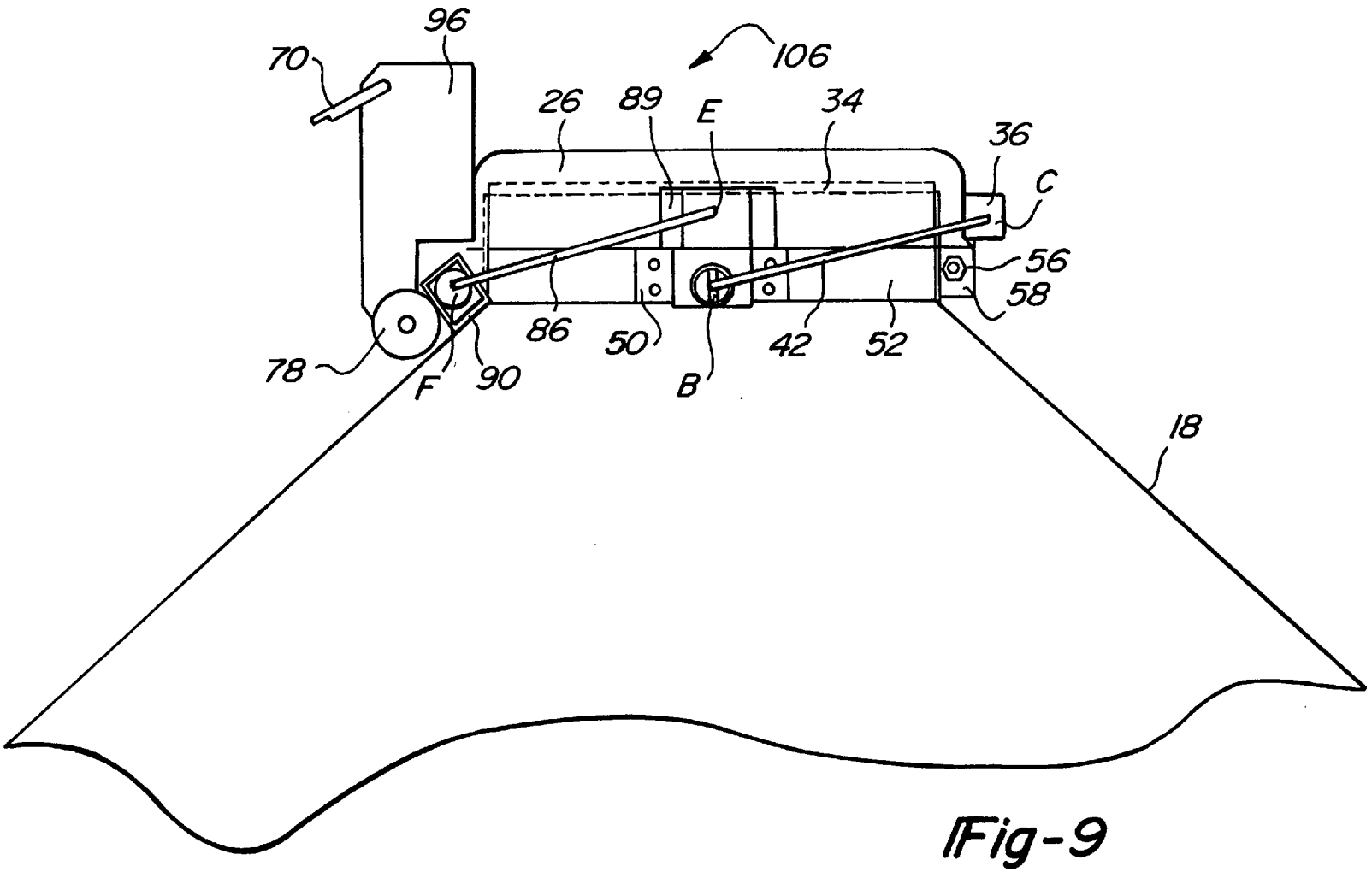
FIG. 9 is a side view of the retractable lid assembly according to the teachings of a third embodiment of the present invention shown in a closed position.
Figure 10:
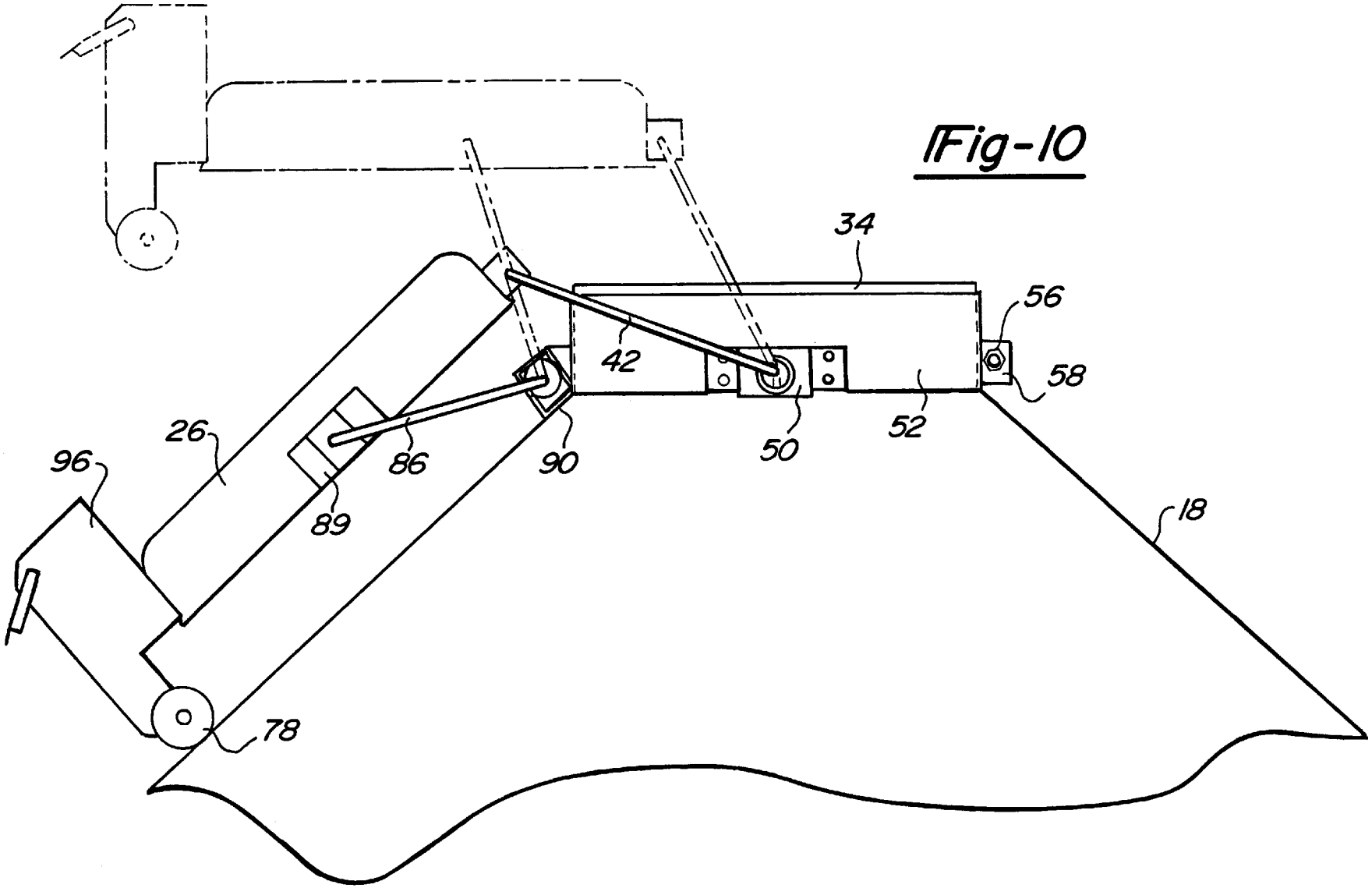
FIG. 10 is a side view of the retractable lid assembly of FIG. 9 shown in a retracted or open position.

Referring to FIGS. 9–10, a third preferred embodiment of a retractable lid assembly 10*b* is shown. The retractable lid assembly 10*b* includes essentially a combination of the elements shown in FIGS. 2–5 and FIGS. 6–8 thus creating a retractable lid assembly 10*b* having a pair of double pivot points (i.e. B/C and E/F). It should also be noted that the latch assemblies 80 or 102 have been eliminated from the third preferred embodiment since pre-tensioning both pairs of torsion springs 62 and 94 securely holds the lid 26 atop the opening 12.

In operation, the retractable lid assembly 10*b* operates substantially similar to the retractable lid assemblies 10 and 10*a* as shown in FIGS. 2–5 and in FIGS. 6–8, respectively. Specifically, the user again pulls the rope 70 with one-hand at ground level. The pulling force on the rope 70 causes the lid 26 to pivot at the two pairs of double pivot points, shown clearly in FIG. 10. In other words, the lid 26 pivots about pivot points B and C, via the bail arm 42, and about pivot points E and F, via the bail arm 86. This pair of double pivot points enables the lid 26 to be retracted while the first surface 28 of the lid 26 remains substantially facing the storage bin 14. Upon retracting the lid 26 to its fully retracted position adjacent and flush to the conical portion 18 of the storage bin 14, the lid 26 can be automatically returned atop the opening 12 by simply releasing the rope 70. Upon releasing the rope 70, the torque built-up in the two pairs of torque springs 62 and 94 causes the lid 26 to be automatically returned atop the opening 12.

Figure 11A:
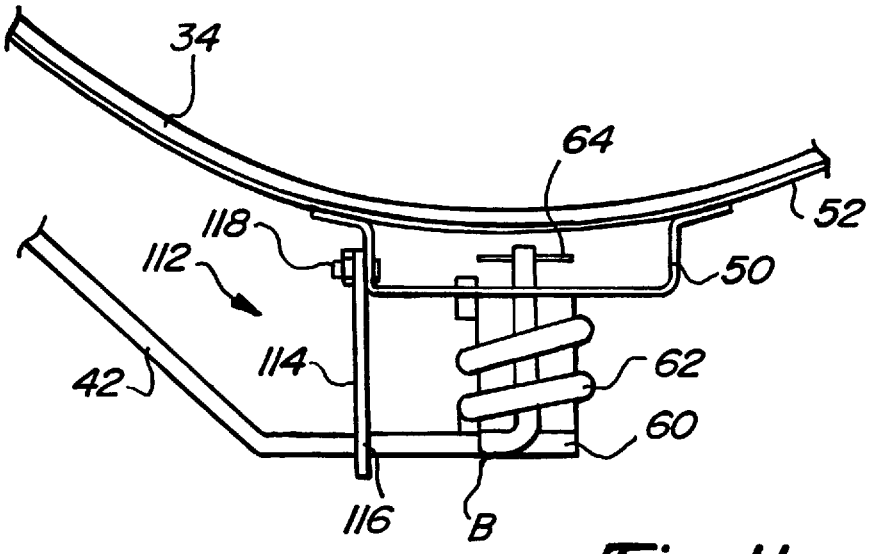
FIG. 11A is a top view of a latch mechanism shown in a latched position when the retractable lid assembly of FIG. 1 is in a retracted or open position.
Figure 11B:
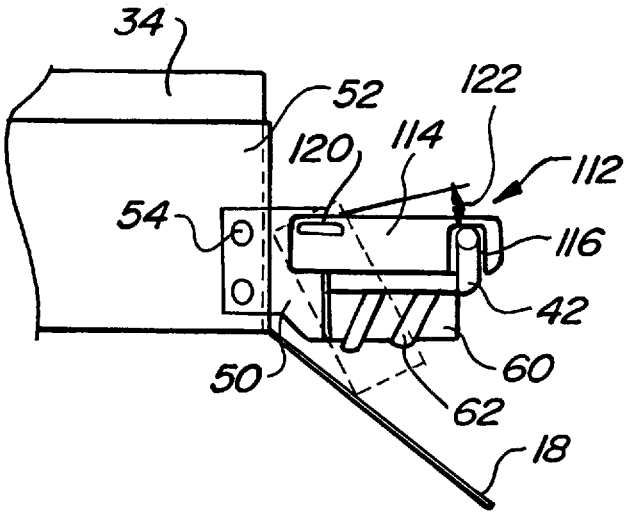
FIG. 11B is a front view of the latch mechanism of FIG. 11A shown in a latched position.

Referring to FIGS. 11A–11B, a latch mechanism 112, which may be incorporated into any of the above-described embodiments, is shown. The latch mechanism 112 includes an arm 114 having a notch 116 for catching and engaging the bail arm 42. An arm 114 is slidably attached to each bail mount 50, via a nut-and-bolt assembly 118. It should be noted that the bail mount 50 is bent to allow the arm 114 to be positioned substantially perpendicular with the bail arm 42 in contrast to the bail arm 50, shown in FIG. 4. Each arm 114 includes a groove 120 which enables the arm 114 to be retracted and placed in a rested position against the conical portion 18 of the storage bin 14, shown clearly in phantom lines in FIG. 11B.

In operation, if a user is required to climb atop the storage bin 114 while the lid 26 is held open, via the rope 70, the user would simply move the arms 114 positioned on each individual bail mount 50 up and over the bail arm 42 such that the notch 116 engages the bail arm 42. Should the rope 70 be released, the bail arm 42 would attempt to pivot at point B, via the tension in the spring 62. The bail arm 42 would thus move clockwise by about 20° to 25° while the arm 114 also rises at an angle 122 of about 20° to 25° until the bail arm 42 binds within the notch 116, thereby still holding the lid 26 in an open or retracted position. As was stated previously, the latch mechanism 112 would generally be used only when a user is required to go atop the storage bin 14, otherwise, the arms 114 are simply rested atop the conical portion 18 of the storage bin 14.

Use of the present invention enables the retractable lid to be retracted while the first surface 28 of the lid 26 remains facing the storage bin 14, thus eliminating the possibility of the lid accumulating moisture or debris similar to conventional lids which are simply flipped or turned over generally at one pivot point. The double pivot action also enables the lid 26 to remain flush against the conical portion 18 of the storage bin 14, thereby substantially reducing the possibility that a dispensing device 16 will strike the retractable lid assembly 10. Moreover, the retractable lid assembly 10 is a single assembly which is secured to the storage bin 14 by simply adjustably mounting the collar member 52 about the rim 34 of the storage bin 14. Such installation and maintaining the retractable lid assembly 10. Still further, use of torsion springs 62 or 94 enable the lid 26 to be automatically returned atop the opening 12 by simply releasing the rope 70 or 108, thereby making the operation of the retractable lid assembly 10 very simple.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. An agricultural storage bin for storing bulk agricultural materials, the agricultural storage bin having a retractable lid assembly for covering an opening in the agricultural storage bin, said agricultural storage bin comprising:

a conically shaped portion extending from said opening;

a cylindrical sidewall portion extending from said conically shaped portion operable to contain the bulk agricultural material received by the agricultural storage bin;

a lower funnel shaped portion extending from said cylindrical sidewall portion operable to guide the bulk agricultural material to ah outlet portion;

a lid for covering the opening in said conically shaped portion, said lid having a first surface facing the agricultural storage bin when said lid covers the opening in said conically shaped portion, and a second surface opposite said first surface; and a retraction mechanism, said retraction mechanism coupled to said lid and said bin to close and open said opening, said retraction mechanism operating to move said lid upwardly away from said opening, and sliding downwardly along said conically shaped portion, wherein said first surface of said lid remains substantially facing the agricultural storage bin during retraction of said lid from the opening in the agricultural storage bin.

2. The agricultural storage bin as defined in claim 1, wherein said retraction mechanism includes a pivot member pivotably attached to said lid at a first pivot point and pivotably attached adjacent to the opening in the storage bin at a second pivot point, wherein said lid is retracted from the opening in the storage bin by pivoting said lid at said first pivot point and said second pivot point.

3. The agricultural storage bin as defined in claim 1, wherein said retraction mechanism includes a first pivot member pivotably attached to said lid at a first pivot point and pivotably attached adjacent to the opening in the storage bin at a second pivot point and a second pivot member pivotably attached to said lid at a third pivot point and pivotably attached adjacent to the opening of the storage bin at a fourth pivot point, wherein said lid is retracted from the opening in the storage bin by pivoting said lid with said first pivot member at said first pivot point and said second pivot point and with said second pivot member at said third pivot point and said fourth pivot point.

4. The agricultural storage bin as defined in claim 1, wherein said retraction mechanism further includes torsion means for automatically returning said lid atop the opening in the storage bin after said lid has been retracted from the opening in the storage bin.

5. The agricultural storage bin as defined in claim 1 wherein said retraction mechanism operates to move a portion of said lid in contact with said conically shaped portion as said lid is slid downwardly along said conically shaped portion.

6. An agricultural storage bin for storing bulk agricultural materials, the agricultural storage bin having a retractable lid assembly for covering an opening in the agricultural storage bin, said agricultural storage bin comprising:

a conically shaped portion extending from said opening;

a cylindrical sidewall portion extending from said conically shaped portion operable to contain the bulk agricultural material received by the agricultural storage bin;

a lower funnel shaped portion extending from said cylindrical sidewall portion operable to guide the bulk agricultural material to an outlet portion;

a lid for covering the opening in said conically shaped portion, said lid having a first surface facing the agricultural storage bin when said lid covers the opening in said conically shaped portion, and a second surface opposite said first surface; and a first pivot member pivotably attached to said lid at a first pivot point and pivotably attached adjacent to the opening in the storage bin at a second pivot point, said first pivot member operating to move said lid upwardly away from said opening, and sliding downwardly along said conically shaped portion, wherein said first surface of said lid remains substantially facing the storage bin during retraction of said lid.

7. The agricultural storage bin as defined in claim 6 further comprising a collar member, said collar member adjustably mounted about the opening in the agricultural storage bin, said first pivot member pivotably attached to said collar member at said second pivot point.

8. The agricultural storage bin as defined in claim 6 further comprising a retraction arm attached to said lid, whereby upon moving said retraction arm, said lid is pivoted about said first pivot point and said second pivot point as said lid is retracted from the opening in the agricultural storage bin.

9. The agricultural storage bin as defined in claim 8 further comprising sliding means attached to said retraction arm for sliding said lid along said storage bin as said lid is retracted from the opening in the agricultural storage bin.

10. The agricultural storage bin as defined in claim 8 further comprising a linkage member attached to said retraction arm and extending along the storage bin to enable a user at ground level to retract said lid from the opening in the agricultural storage bin.

11. The agricultural storage bin as defined in claim 6 further comprising torsion means for automatically returning said lid atop the opening in the storage bin after said lid has been retracted from the opening in the agricultural storage bin.

12. The agricultural storage bin as defined in claim 9, wherein said torsion means includes a torsion spring positioned at said second pivot point.

13. The agricultural storage bin as defined in claim 6 further comprising a second pivot member pivotably attached to said lid at a third pivot point and pivotably attached adjacent to the opening in the agricultural storage bin at a fourth pivot point.

14. The agricultural storage bin as defined in claim 13, wherein said lid is retracted from the opening in the agricultural storage bin as said first pivot member pivots at said first pivot point and said second pivot point and said second pivot member pivots at said third pivot point and said fourth pivot point while said first surface of said lid remains substantially facing the agricultural storage bin during retraction of said lid.

15. The agricultural storage bin as defined in claim 6, wherein said lid remains substantially flush to said agricultural storage bin in a fully retracted position.

16. The agricultural storage bin as defined in claim 6 further comprising a latch mechanism, said latch mechanism engages said first pivot member when said lid is in a retracted position.

17. An agricultural storage bin for storing bulk agricultural materials, the agricultural storage bin having a retractable lid assembly for covering an opening in the agricultural storage bin, said agricultural storage bin comprising:

a conically shaped portion extending from said opening;

a cylindrical sidewall portion extending from said conically shaped portion operable to contain the bulk agricultural material received by the agricultural storage bin;

a lower funnel shaped portion extending from said cylindrical sidewall portion operable to guide the bulk agricultural material to an outlet portion;

a lid for covering the opening in the agricultural storage bin, said lid having a first surface facing the agricultural storage bin and a second surface opposite said first surface;

a first pivot member pivotably attached to said lid at a first pivot point and pivotably attached adjacent to the opening in the storage bin at a second pivot point, said first pivot member operating to move said lid upwardly away from said opening, and sliding downwardly along said conically shaped portion; and a torsion mechanism attached to said first pivot member for automatically returning said lid atop the opening in the storage bin after said lid has been retracted from the opening in the storage bin, wherein said first surface of said lid remains substantially facing the storage bin during retraction of said lid from the opening in the storage bin.

18. The agricultural storage bin as defined in claim 17 further comprising a retraction arm attached to said lid, whereby upon moving said retraction arm, said lid is pivoted about said first pivot point and said second pivot point as said lid is retracted from the opening in the storage bin.

19. The agricultural storage bin as defined in claim 18 further comprising a sliding mechanism attached to said retraction arm for sliding said lid along said storage bin as said lid is retracted from and returned to the opening in the storage bin.

20. The agricultural storage bin as defined in claim 18 further comprising a linkage member attached to said retraction arm and extending along the agricultural storage bin to enable a user at ground level to retract said lid from the opening in the agricultural storage bin.

21. The agricultural storage bin as defined in claim 17, wherein said torsion mechanism includes a torsion spring position at said second pivot point.

22. The agricultural storage bin as defined in claim 17 further comprising a second pivot member pivotably attached to said lid at a third pivot point and pivotably attached adjacent to the opening in the agricultural storage bin at a fourth pivot point.

23. The agricultural storage bin as defined in claim 22, wherein said lid is retracted from the opening in the agricultural storage bin as said first pivot member pivots at said first pivot point and said second pivot point and said second pivot member pivots at said third pivot point and said fourth pivot point while said first surface of said lid remains substantially facing the agricultural storage bin during retraction of said lid.

24. The agricultural storage bin as defined in claim 17, wherein said lid remains substantially flush to said agricultural storage bin in a fully retracted position.

25. The agricultural storage bin as defined in claim 17 further comprising a latch mechanism, said latch mechanism engages said first pivot member when said lid is in a retracted position.

* * * * *